US005772015A

United States Patent [19]

Musiel et al.

[11] Patent Number: 5,772,015

[45] Date of Patent: Jun. 30, 1998

[54] COMBINED BRUSH AND STORAGE CONTAINER SYSTEM THEREFOR

[75] Inventors: Donald J. Musiel; Ronald G. Cramer, both of Racine, Wis.

[73] Assignee: S. C. Johnson & Son, Inc., Racine, Wis.

[21] Appl. No.: 805,832

[22] Filed: Mar. 3, 1997

[51] Int. Cl.[6] ..... B65D 83/00

[52] U.S. Cl. ..... 206/209; 206/1.5; 206/15.3

[58] Field of Search ..... 206/205, 207, 206/209, 209.1, 361, 15.2, 15.3, 225, 233, 1.5, 823; 53/420, 431, 474, 489

[56] References Cited

U.S. PATENT DOCUMENTS

| | | | |
|---|---|---|---|
| 287,189 | 10/1883 | Stone . | |
| 539,925 | 5/1895 | Swan . | |
| 878,437 | 2/1908 | Volger . | |
| 2,723,773 | 11/1955 | Greene . | |
| 3,185,291 | 5/1965 | Lerner | 206/209 |
| 3,361,507 | 1/1968 | O'Neil | 206/361 |
| 3,450,452 | 6/1969 | Reid | 206/361 |
| 3,569,903 | 3/1971 | Brishka . | |
| 3,863,798 | 2/1975 | Kurihara et al. . | |
| 4,116,352 | 9/1978 | Davis . | |
| 4,187,953 | 2/1980 | Turner . | |
| 4,211,750 | 7/1980 | Gillespie | 206/361 |
| 4,691,943 | 9/1987 | De Land et al. . | |
| 4,770,307 | 9/1988 | Guglielmi . | |
| 4,834,423 | 5/1989 | De Land . | |
| 5,127,538 | 7/1992 | Shinno . | |
| 5,161,834 | 11/1992 | Norkey . | |
| 5,294,011 | 3/1994 | Konrad et al. . | |
| 5,566,823 | 10/1996 | Summers | 206/209 |

OTHER PUBLICATIONS

Prodimex home page ad entitled "Toilet Brush Holder", dated Nov. 22, 1996 (unclear whether prior art).

*Primary Examiner*—Paul T. Sewell
*Assistant Examiner*—Luan K. Bui

[57] ABSTRACT

Disclosed herein is a combined toilet bowl cleaning brush and storage container system. The brush is provided with a disk shaped wall which rests on an internal sealing ledge of the container. A latching system is provided above the disk shaped wall to hold the wall in place and seal the container. There is also a slip ring which unlatches the brush.

8 Claims, 2 Drawing Sheets

COMBINED BRUSH AND STORAGE CONTAINER SYSTEM THEREFOR

CROSS-REFERENCE TO RELATED APPLICATION

Not applicable.

STATEMENT REGARDING FEDERALLY SPONSORED RESEARCH

Not applicable.

BACKGROUND OF THE INVENTION

This invention relates to toilet bowl cleaning implements and containers for storing them. More particularly, it relates to leak resistant containers for storing such implements.

Toilet bowls can become stained due to chemicals that are present in the water supply or due to residual waste. Many cleaning products for toilet bowls contain surfactants which are designed to be applied to such stains with a brush. Even after rinsing such brushes after use there can still be residual waste on the toilet brush (or at least the perception that such waste has not been fully rinsed off). In any event the brush will be damp.

As such, toilet bowl brushes are often stored in a container between uses. These containers are sometimes provided with a liquid disinfectant so that the brush can be sanitized between uses. However, the disinfectants (and sometimes the brushes) can have an undesirable odor. Moreover, there is some risk of spillage when transporting the container from bathroom to bathroom.

Some prior art containers are designed to enclose the brush during storage. However, they are unnecessarily complex, and/or are not sufficiently sealed so as to prevent spillage.

It can therefore be seen that a need exists for an improved toilet bowl implement/container system.

DISCLOSURE OF THE INVENTION

In one aspect the invention provides a combined implement, such as a brush, and storage container system. There is a container having an upper edge, an internal storage cavity extending downward from the edge to define a peripheral cavity sidewall, and a ledge formed on the sidewall. There is also a radially resiliently movable latch positioned above the ledge along the sidewall.

A vertically moveable key is mounted over the container upper edge which has a portion that extends downwardly therefrom into the cavity adjacent the latch.

A brush is provided having an upper handle, a radially extending support below the upper handle, and a lower brush portion.

Downward vertical movement of the key from a first position to a second position can drive the latch radially outward from a position blocking removal of the brush to a position not blocking removal of the brush. The return of the key to the first position (when the brush is returned) will cause the latch to move radially inward to a locking position.

In a preferred aspect, the latch is a leg which is attached to the cavity sidewall adjacent a knee-like upper end. The leg has a lower foot which extends radially inward from the leg.

The key can be in the form of a skirt with a downwardly opening cavity which receives the upper edge. A downwardly projecting wall of the skirt contacts the leg. Downward movement of the skirt drives the foot radially outward.

The brush support is a wall (preferably disk shaped). A gasket is positioned on the ledge. There are plurality of latches arrayed around the cavity sidewall. The feet retain the wall in sealing engagement against the gasket.

In another aspect, the invention provides a method of storing such a brush in a storage container. One stores liquid disinfectant in the cavity, positions a toilet brush in the container, and causes the feet of the latch to retain the support against the gasket.

It will be appreciated from the discussion below that the present invention provides an assembly for storing a toilet bowl cleaning brush where the bristles/pad of the brush are immersed in a disinfectant between use, yet there is reduced risk of spillage from the container. A user can even pick up the assembly by the brush handle and transport the entire assembly to another place.

A primary object of the invention is to provide a storage container for a cleaning brush in which the container is designed to store both the brush and a disinfectant, with reduced risk of spillage.

Another object of the invention is to provide a system of the above kind which prevents odors from escaping the container.

Another object of the invention is to provide a system of the above kind which is comprised of few parts, which is inexpensive to produce, and which is easy for a consumer to use.

Still other objects and advantage of the present invention (e.g. methods for using these systems) will become apparent from examination of the specification and claims which follow.

DETAILED DESCRIPTION OF THE INVENTION

Figure 1:
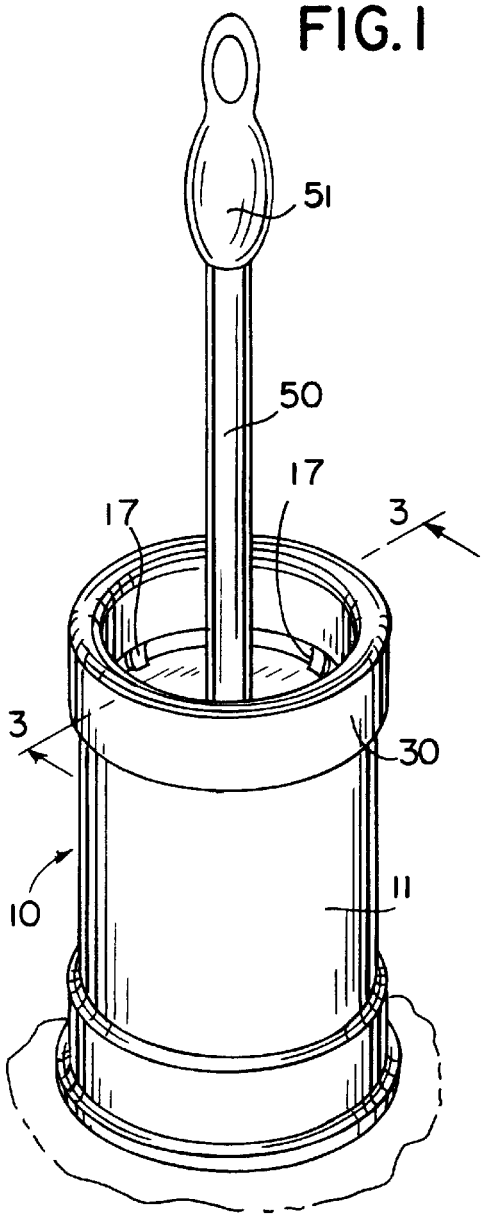
FIG. 1 is perspective view of an embodiment of the present invention.
Figure 3:
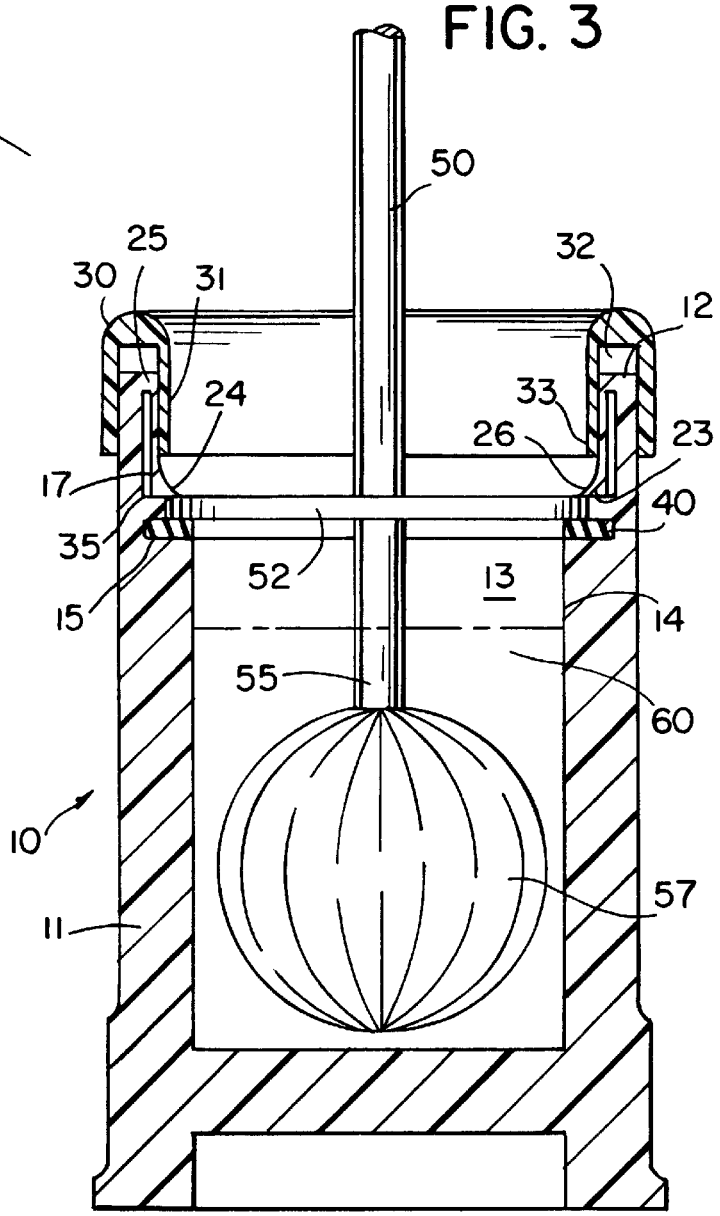
FIG. 3 is a cross-sectional view taken along line 3—3 in FIG. 1.
Figure 2:
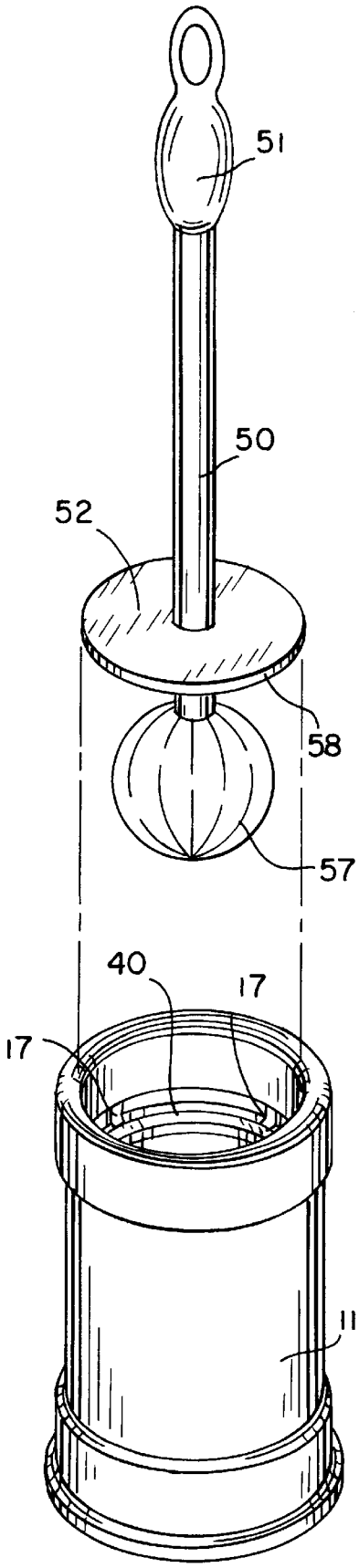
FIG. 2 depicts the embodiment of FIG. 1 in an unlocked position.

FIG. 1 shows the combined brush and storage system of the present invention (generally 10). As best seen in FIG. 3, there is an outer cylindrical container 11 that has an upper edge 12, an inner storage cavity 13 and peripheral cavity sidewall 14. Ledge 15 is formed on the sidewall and surrounds the cavity. The container is made of a plastic such as ABS or polyethylene.

Figure 4:
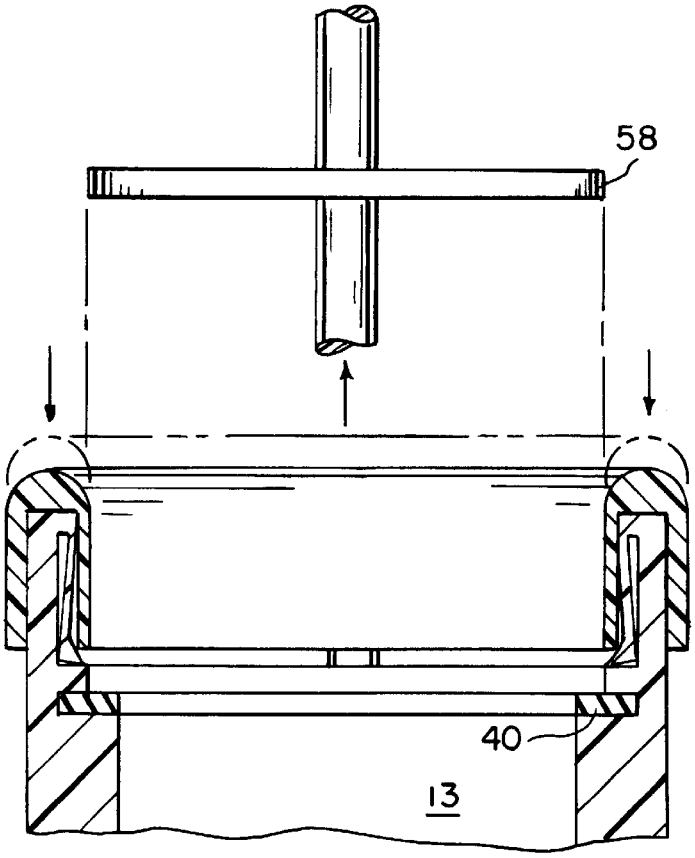
FIG. 4 is a view similar to a portion of FIG. 3, but enlarged and with the skirt in a downward position so as to depict an unlocked assembly.

A plurality of integrally formed latches 17 (preferably three or four, equally spaced around the upper edge) are positioned above the ledge 15 along the sidewall 14. As best seen in FIG. 3, the latches 17 are in the form of resilient legs 23 having feet 24, knees 25, and ankles 26. Alternatively, the latches may also be positioned below the ledge 15 along the sidewall and are able to flex radially inward and outward (not shown). Legs 23 are able to flex radially inward and outward (compare FIG. 3 to FIG. 4).

Key 30 is in the form of a slip ring or skirt 31 mounted over the container upper edge 12. The skirt has a downwardly open cavity 32. Its inner wall 33 extends downwardly into the cavity 13 adjacent a leg 23. When the skirt 31 is pushed downwardly its lower portion 33 pushes against ankles 26 of the latches 17, thereby providing a radially outward force adjacent clearance area 35.

There is also a gasket 40 positioned on ledge 15. It is preferably made of rubber or a synthetic sealing material such as resilient expanded plastic.

A brush assembly (generally 50) has an upper handle 51, and a radially extending generally disk-like support wall 52 which is preferably sized to rest on the gasket 40 and thus on the ledge 15. There is also a conventional extension 55 and a bristle or pad section 57. Alternatively, other brushing means can be used.

Disinfectant/cleaning fluid 60 can be added to the cavity 13 to cover bristles 57. Numerous known fluids of this type can be used. One such fluid is 0.4% alkyl dimethyl benzyl ammonium chloride, 0.01% of a dye such as Acid Blue, and the remainder water. If desired, a portion of the water can be replaced with a surfactant compatible with the disinfectant to provide 1% non-ionic surfactant (e.g. an ethoxylated alcohol such as L-24-9 from Huntsman). Also, a perfume oil can also be added (e.g. 0.1%). Other disinfectants may also be used.

In the storage position, feet 24 of the latches 17 "step on" the support disk 52 to retain it in place in a sealed fashion. (See FIG. 3). However, if a user presses the skirt downwardly from the FIG. 3 (first) position to the FIG. 4 (second) position, wall 33 of the ring will drive the feet radially outwardly to an unblocking position. (See FIG. 4). The brush 50 can then be removed. After removing the brush, one can leave the skirt in the down position until the brush is returned. After use, the brush can then be returned. One can then pull the support ring upward. The resiliency of the legs will then cause the legs to move radially inward into the FIG. 3 blocking position.

A more preferred alternative arrangement is for the legs instead to inherently be sufficiently resilient so as to drive the skirt up whenever it is not being held down by the consumer. In such a case, when the brush is being reinserted into the cavity, downward movement of edge 58 of the brush will drive the feet out of the blocking position until the edge 58 passes below it. The legs will then snap inwards to lock the brush in place.

Alternatively, a coil spring (not shown) can be positioned on edge 12 and extend into in skirt cavity 32. This will insure that the skirt will promptly return to the lock position.

What has been described above are the preferred embodiments of the present invention. Other embodiments are also within the intended scope of the claims. For example, the cavity and the container need not be cylindrical. They may be square or have other configurations. Further, while use of a separate seal below the brush support is preferred it is not required (e.g. the support itself can have a lower rubber surface).

Also, a skirt is not the only type of "key". There could instead be separate clips near the latch legs.

As such, the claims which follow should be looked to in order to judge the full scope of the invention.

Industrial Applicability

The present invention is useful in permitting toilet bowl and other cleaning brushes to be stored in a sanitary manner.

We claim:

1. A combined brush and storage container system, comprising:

a container having an upper edge, an internal storage cavity extending downward from the edge to define a peripheral cavity sidewall, a ledge formed on the sidewall, and a radially resiliently movable latch positioned above the ledge along the sidewall;

a vertically movable key mounted over the container upper edge and having a portion thereof extending downward into the cavity adjacent the latch;

a brush having an upper handle, a radially extending support below the upper handle and a lower brush portion;

wherein downward vertical movement of the key from a first position to a second position can drive the latch radially outward from a position blocking removal of the brush to a position not blocking removal of the brush, and wherein the return of the key to the first position from the second position can cause the latch to move radially inward.

2. The system of claim 1, wherein the latch is in the form of a resilient leg attached adjacent its upper end to the cavity sidewall and having a lower foot section which extends radially inward.

3. The system of claim 2, wherein the key is a skirt having a downwardly open cavity for receiving the container upper edge and having a wall for contacting the leg.

4. The system of claim 1, wherein the brush support is a wall.

5. The system of claim 4, further comprising a gasket positioned on the ledge.

6. The system of claim 1, wherein the system also comprises a disinfectant fluid in the container cavity.

7. The system of claim 5, wherein there are plurality of such latches arrayed around the cavity sidewall, each having such feet, wherein the feet retain the brush support wall in sealing engagement with the gasket.

8. A method of storing a brush, comprising positioning the claim 1 toilet cleaning brush in the claim 1 container.

* * * * *